US006176271B1

(12) United States Patent
Sayers et al.

(10) Patent No.: US 6,176,271 B1
(45) Date of Patent: Jan. 23, 2001

(54) FABRIC SEAMS

(75) Inventors: Ian Christison Sayers, Lancashire; Robert L. Crook, Wilson; Sanjay Patel, Summerville, all of (GB)

(73) Assignee: Scapa Group PLC, Blackburn (GB)

( * ) Notice: Under 35 U.S.C. 154(b), the term of this patent shall be extended for 0 days.

(21) Appl. No.: 09/323,245

(22) Filed: Jun. 1, 1999

(51) Int. Cl.[7] ..... D03D 1/04
(52) U.S. Cl. ..... 139/389 AA
(58) Field of Search ..... 139/383 AA

(56) References Cited

U.S. PATENT DOCUMENTS

| | | | | |
|---|---|---|---|---|
| Re. 35,966 | | 11/1998 | Lee | 139/383 AA |
| 4,500,590 | * | 2/1985 | Smith | 428/222 |
| 4,775,446 | | 10/1988 | Eschmann | 162/348 |
| 4,846,231 | | 7/1989 | Penven | 139/383 AA |
| 5,053,109 | * | 10/1991 | Penven | 162/348 |
| 5,330,604 | | 7/1994 | Allum et al. | 156/304.7 |
| 5,480,604 | * | 1/1996 | Johnson et al. | 264/138 |
| 5,657,797 | * | 8/1997 | Townley et al. | 139/383 AA |
| 5,746,257 | * | 5/1998 | Fry | 139/383 AA |
| 5,875,822 | * | 3/1999 | Fargeout | 139/383 AA |

FOREIGN PATENT DOCUMENTS

| | | |
|---|---|---|
| 0 287 229 | 10/1988 | (EP) . |
| 2 494 233 | 5/1982 | (FR) . |
| 2 216 914 | 10/1989 | (GB) . |
| 98/19077 | 5/1998 | (WO) . |

* cited by examiner

*Primary Examiner*—John J. Calvert
*Assistant Examiner*—Robert H. Muromoto, Jr.
(74) *Attorney, Agent, or Firm*—Jacobson, Price, Holman & Stern, PLLC

(57) ABSTRACT

In a seam, for example, for paper machine clothing, interdigitating seaming loops (13, 14) embrace deformable yarns (17) inserted between the last cross-machine direction yarns **(15*a*) and the opposed seaming loops (14, 13). Alternatively, an insert may be in the form of a ladder-like member (30) comprising one or more cross-machine direction members (31, 32, 33) and a multiplicity of machine direction members (34) extending beyond the members (31, 32, 33)** to locate the seaming loops. Also possible is the use of a strip or tape of foamed or foamable material.

5 Claims, 1 Drawing Sheet

FABRIC SEAMS

This invention relates to improvements in fabric seams, as used for joining, e.g., papermachine clothing, especially press felts, into endless fabrics.

A common form of seam uses selected yarns extending in the longitudinal (machine direction, or MD) direction of the fabric to form loops which extend beyond the fabric end and can be interdigitated with corresponding loops on the other fabric end, to be joined by a pintle or binding yarn passed along the tunnel formed by the interdigitated loops. In an alternative, the interdigitatable loops may be formed by helical seaming spirals which are bound into the fabric edge by a holding yarn and/or loops formed by MD yarns.

Seam constructions of this nature often present a problem particularly with regard to marking of the paper sheet with hydraulic marks, caused by a density difference in the seam area due to the seam area being generally more open than the main body of the fabric. One proposal for alleviating this problem is discussed in our published International Patent No. WO 98/19077 wherein it is proposed to form the pintle wire or binding yarn from or incorporating an expansible component to fill some of the void space in the seam. The said application focuses on the pintle region, to fill the space within the interdigitated loops. The region where the loops are joined to the fabric edge also however includes a higher proportion of void space than the main body of the fabric. This is a particular problem when large core yarns form long seam loops greater than 1.4 mm in length during the felt basecloth weaving process, as discussed for example in EP-A-0,287,229.

It is an object of the invention to provide a seam construction whereby the propensity of the seam to mark the paper web is reduced.

According to the invention a fabric seam construction, for joining an industrial fabric such as papermachine clothing to form an endless belt, the seam construction comprising seaming loops formed from or connected to the fabric and interdigitatable with similar loops on the opposed fabric edge for connection with at least one pintle wire or binding yarn passed through the interdigitated loops, is characterised in that cross machine direction extending means are provided for closing the gap between the cross machine direction extending fabric yarns and the seaming loops of the opposed fabric end.

Said cross machine direction extending means may be in the form of a yarn, and may be elastic or resilient in nature.

The said means may be provided as a resilient deformable packing yarn inserted between the end CD yarn of the fabric and the ends of the seaming loops of the opposed fabric end.

Alternatively, the means may be provided as an elastic deformable yarn inserted into the end region of the fabric, to resiliently urge the end CD yarns into contact with the ends of the seaming loops of the opposed fabric end.

In an alternative, the said means may comprise an elongate member, comprising one or more continuous elements, for disposition in the cross machine direction of the fabric, and an array of transverse elements, extending across and beyond said continuous elements.

The elongate member may comprise a narrow mesh strip, comprising for example two, three or four etc continuous elements, and the transverse elements may be spaced to enter between seaming loops extending from each end of the fabric.

The elongate member may take the place of one or more CD yarns in the fabric end region, or may be used as a pintle for interconnecting interdigitated seaming loops, or as a binding yarn for binding a seaming spiral into the fabric end.

The elongate member can optionally comprise a spine formed of a single yarn, with ladder like cross wise members extending from the yarn to opposite sides thereof. Other variants of the elongate member may comprise thin woven or knitted strips with frayed selvedges, or hot pressed or melt bonded yarn tows.

In another embodiment, the means may comprise a strip or tape of a foamed or foamable material.

In the case of a narrow mesh strip, the mesh may comprise a matrix of a suitable synthetic material, such as plastics, and at least one of the continuous elements preferably incorporates a reinforcing yarn.

The said means may be expansible, or include parts which are expansible, as set out in the aforesaid International Patent Application.

Embodiments of the invention will now be described by way of example with reference to the accompanying drawings, wherein:

FIG. 1 is a diagrammatic cross section of a first embodiment of seam construction according to the invention;

FIG. 2*a* is a cross section of a yarn for use in the seam constructions of FIG. 1, in a relaxed uncompressed state;

FIG. 2*b* is a cross section of the yarn of FIG. 2*a* compressed by contact with neighbouring yarns etc when the fabric is subjected to tension in the machine direction;

Figure 1:
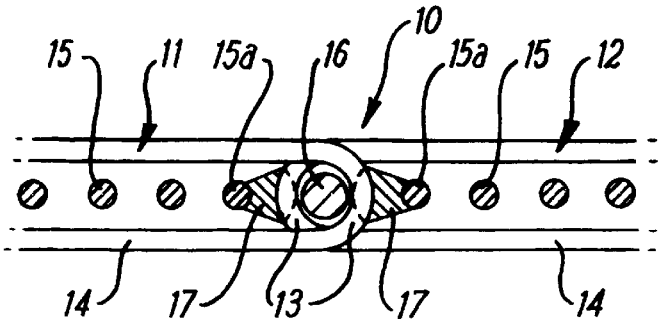

The embodiment of the invention illustrated in FIG. 1 comprises a fabric 10, the ends 11, 12 of which are joined by seaming loops 13 formed by yarns 14 extending in the machine direction(MD). The last few cross machine (CD) yarns 15 of each end of the fabric are shown. The seaming loops 13 are interdigitated as usual, and a relatively thick yarn 16 is provided to provide a pintle wire for joining the loops 13.

In accordance with this embodiment of the invention, a packing yarn 17 of resiliently deformable material is inserted at each side of the seam, between the ends of the loops 13 of the opposing end of the respective fabric end. These packing yarns 17 are deformed by the pressure exerted by tensioning of the belt formed when the fabric is joined by the seam.

The deformed packing yarns 17 ensure that the loops 13 are pressed firmly against the pintle yarn 16, and fill the seam area between the last end yarns 15*a*, so that the void space in the seam area is considerably reduced, preferably to a similar proportion as that of the main body of the fabric 10.

Figure 2A:
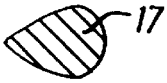
Figure 2B:
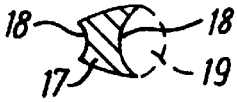

FIG. 2*a* shows one packing yarn 17 in its relaxed, uncompressed state, and it will be noted that this preferred embodiment of packing yarn has a tear drop shaped cross section. When compressed, as described above the cross section of the packing yarn 17 is deformed by the MD acting pressure created by belt tension to the cross section shown in FIG. 2*b*, with the yarn 17 now double concave in section, the curvature of the concavities 18 matching the profiles of the end CD yarn 15*a*, and the loops 13, with projections 19 located between the loops 13.

Figure 3:
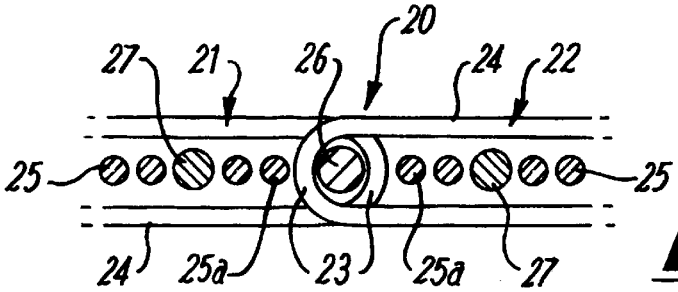
FIG. 3 is a similar view to FIG. 1 of a second embodiment of seam construction according to the invention.

In FIG. 3, a fabric 20 comprises ends 21, 22 joined by a seam comprising loops 23, provided by MD yarns 24. The interdigitated loops 23 are joined by a pintle 26 in the usual way. CD yarns 25 extend parallel to the ends of the fabric. A larger diameter yarn 27 is inserted to extend in the CD direction parallel to yarns 25, and this yarn 27 is of an elastic material, acting as a packing yarn to urge the end-most CD yarns 25*a* of the fabric into contact with the ends of the loops 23 of the opposed fabric end, to thereby close up the spaces in the seam area.

Figure 4:
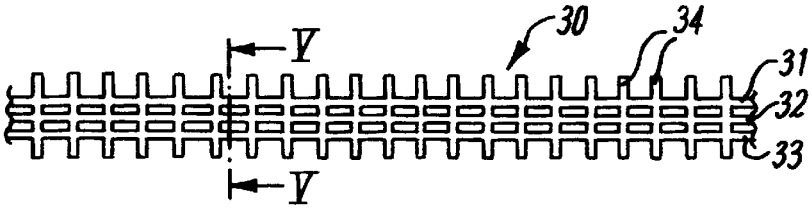
FIG. 4 is a plan view of a part of a member for use in a further embodiment of the invention.
Figure 5:
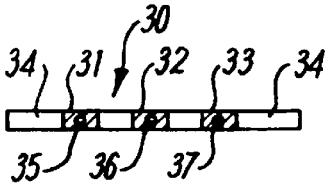
FIG. 5 is a section of the member of FIG. 4 in line V—V of FIG. 4.

FIG. 4 is a plan view of a short length of a further embodiment of packing member 30, which can be arranged in the seam structure, extending in the CD directions parallel to the CD yarns of the fabric. Member 30 is in the form of a narrow strip of resilient mesh material, comprising in this instance three longitudinal members 31, 32, 33, for extending in the CD direction, and a multiplicity of transverse members 34, at right angles to the longitudinal members, forming a ladder like structure, with the ends of members 34 extending beyond the outer members 31, 33. These ends provide a comb structure which can be used to locate loops formed by yarns or spiral seaming members lying in the machine direction. FIG. 5 shows a sectional view of member 30, showing that the member comprises a matrix of a plastics material with reinforcing yarns 35, 36, 37 running lengthwise numbers 31, 31, 33. These yarns may be of for example an aramid, polyester or polyamide material. A narrow strip of resilient mesh material without reinforcing yarns in the longitudinal members can also be used.

Figure 6:
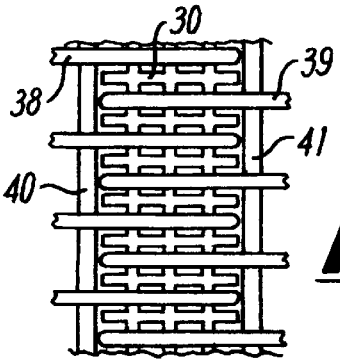
FIG. 6 is a fragmentary plan view of part of a seam construction according to the further embodiment of the invention utilising a member similar to that shown in FIGS. 4 and 5.

FIG. 6 shows diagrammatically the use of member 30 in a seam, either as a pintle, joining seaming loops or spirals, or as an edge binder member, connecting a seaming spiral to binding loops formed by MD yarns of the fabric. As shown, the protruding ends of members 34 serve to locate loops 38 extending from one side to interdigitate with loops 39 extending from the outer side. The member 30 serves to fill in the seam area, e.g. between CD yarns 40, 41 which may be respective fabric end yarns, or an end yarn and a pintle depending upon the use of the member 30.

The packing yarn 17 may be a resilient material e.g. thermoplastic polyurethane, polyether or polybutylene terephthalate, to enable it to deform as described.

The elastic yarn 27 may be a rubber, such as neoprene or polynorbornene, silicone rubber, a thermoplastic polyurethane, a thermoplastic polyethylene or elastomeric polyester. The yarn may be comprised of two or more elastic filaments, or the shape memory polymer can be provided as a coated or co-extruded layer on a yarn core.

The member 30 may be of any suitable polymer, mineral or metal material, especially the longitudinal members, which may be a single spine, or two or three or four etc in number. The cross members 34 may be of a comparatively flexible material such as a thermoplastic polyurethane, rubber, silicone, polyether, polyamide, or polyester, and these may be yarns filaments or cast strands.

Any of the above packing members or yarns can be made to be expansible, to further fill the seam area, by use of materials disclosed in our above identified International Patent Application WO 98/19077.

What is claimed is:

1. A fabric seam construction for joining an industrial fabric to form an endless belt, the seam construction comprising first seaming loops formed from the fabric, and interdigitatable with second loops on an opposed fabric edge for connection with at least one binding yarn passed through the interdigitated loops, wherein the binding yarn is tear drop shaped in cross section and cross machine direction resilient elements in each fabric end to bear directly or indirectly on the seaming loops of opposed fabric ends.

2. The fabric seam construction according to claim 1, wherein said cross machine direction resilient elements comprise an elastic or resilient yarn.

3. The fabric seam construction according to claim 2, wherein said elastic or resilient yarn is a resiliently deformable packing yarn inserted between an end cross machine direction yarn of the fabric and the ends of the seaming loops.

4. The fabric seam construction according to claim 2, wherein said elastic or resilient yarn comprises an elastic deformable cross machine direction yarn inserted into an end region of the fabric to resiliently urge end cross machine direction yarns into contact with ends of the seaming loops of the opposed fabric end.

5. The fabric seam construction according to claim 1, wherein the industrial fabric is papermachine clothing.

* * * * *